United States Patent [19]

Widmer

[11] Patent Number: 4,460,051

[45] Date of Patent: Jul. 17, 1984

[54] PERCUSSION DRILL HAMMER

[75] Inventor: Dieter Widmer, Uerikon, Switzerland

[73] Assignee: Spindel-, Motoren- und Maschinenfabrik AG, Uster, Switzerland

[21] Appl. No.: 479,670

[22] Filed: Mar. 28, 1983

Related U.S. Application Data

[63] Continuation of Ser. No. 197,107, Sep. 30, 1980, abandoned.

[30] Foreign Application Priority Data

Feb. 12, 1979 [CH] Switzerland ..... 1340/79

[51] Int. Cl.[3] ..... B25D 17/24

[52] U.S. Cl. ..... 173/134; 173/162 R; 267/137

[58] Field of Search ..... 173/116, 118, 134, 139, 173/162 R, DIG. 2, 135; 267/137; 91/300, 321

[56] References Cited

U.S. PATENT DOCUMENTS

| | | | |
|---|---|---|---|
| 1,430,764 | 10/1922 | Smith | 91/321 X |
| 2,248,546 | 7/1941 | Morrison et al. | 91/321 X |
| 2,875,731 | 3/1959 | Settles et al. | 173/162 X |
| 2,985,139 | 5/1961 | Powers et al. | 173/139 X |
| 3,028,841 | 4/1962 | Leavell | 267/137 X |
| 3,411,592 | 11/1968 | Montabert | 173/134 |
| 3,651,874 | 3/1972 | Sudnishnikov et al. | 173/135 X |
| 3,788,404 | 1/1974 | Koudelka et al. | 173/139 |
| 4,203,446 | 5/1980 | Hofert et al. | 173/139 X |

FOREIGN PATENT DOCUMENTS

| | | | |
|---|---|---|---|
| 1531076 | 6/1968 | France . | |
| 2344379 | 10/1977 | France . | |
| 20091 | of 1913 | United Kingdom . | |
| 619733 | 8/1978 | U.S.S.R. | 173/116 |
| 727419 | 4/1980 | U.S.S.R. | 173/139 |

*Primary Examiner*—Robert P. Olszewski
*Attorney, Agent, or Firm*—Werner W. Kleeman

[57] ABSTRACT

In a cylinder formed in a casing a hammer piston is mounted for reciprocating motion and is subjected to periodic pressure pulses from a pressure fluid. To prevent a reaction emanating from each pressure pulse from also acting as a shock on the casing, a balance or compensation mass body is provided in the casing which mass body is subjected to the pressure pulses in the direction opposite to that for the hammer piston and is displaceable parallel to the latter against the action of a spring supported in the casing. Together with the spring, the mass body forms an oscillator, the characteristic frequency of which is advantageously to be selected to be at most half, but preferably one third, of the frequency of the pressure pulses. In this way, the reaction shocks are smoothed out to a recoil force which fluctuates narrowly about a mean value and which can be kept lower than the weight of the casing, so that the casing is not subjected to any recoil accelerations.

4 Claims, 1 Drawing Figure

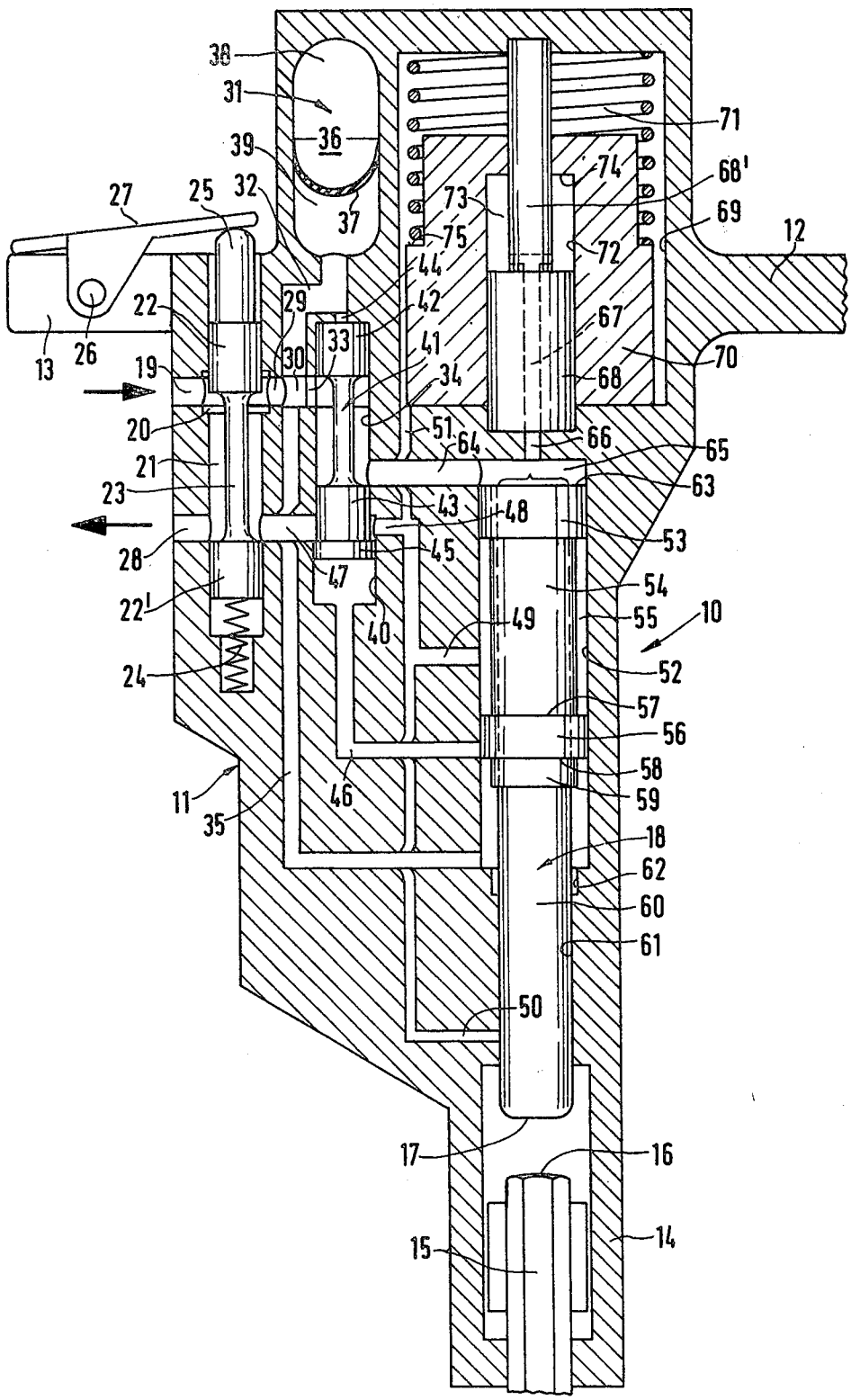
38
31
36
39
37
27
25
32
71
74
68'
73
69
12
75
72
44
42
22
29
67
33
41
13
26
30
70
19
34
68
20
51
64
66
65
21
63
23
43
48
53
28
45
47
54
22'
40
49
55
10
24
52
57
56
58
11
46
59
35
18
62
60
61
50
17
16
15
14

PERCUSSION DRILL HAMMER

CROSS REFERENCE TO RELATED APPLICATION

This application is a continuation application of my commonly assigned, copending United States application Ser. No. 06/197,107, filed Sept. 30, 1980 and entitled "Percussion Drill Hammer", now abandoned.

BACKGROUND OF THE INVENTION

1. Field of the Invention

The present invention relates to a percussion drill hammer having a cylinder which is located in a casing and in which a hammer piston is mounted for reciprocating motion and can be driven by means of periodic pressure pulses of a pressure fluid, in order to carry out percussive strokes.

2. Description of the Prior Art

In known percussion drill hammers of this type, the casing undergoes, as a reaction, a brief and violent recoil during each pressure pulse which accelerates the hammer pistons up to a percussive stroke. These recoils generate a vibration which is inconvenient and also harmful to the operator. To damp these inconvenient vibrations to a certain extent, it was customary hitherto to select the weight of the casing to be very considerably greater than that of the hammer piston, but this is detrimental to the percussive power of the hammer piston on the one hand and to the ease of handling of the percussion drill hammer on the other hand.

SUMMARY OF THE INVENTION

It is therefore an object of the invention to provide a percussion drill hammer of the type initially stated, wherein the individual recoil pulses are smoothed out to a substantially constant, that is to say, largely vibration-free reaction force which also acts in the periods between the individual pressure pulses.

To achieve this object, the proposed percussion drill hammer according to the invention is characterized in that a balance or compensation mass body is provided, which is subjected to the pressure pulses in the direction opposite to that for the hammer piston and is displaceable parallel to the latter and against the action of a spring supported in the casing.

BRIEF DESCRIPTION OF THE DRAWING

The invention is explained in more detail, purely by way of example, by reference to the drawing. The only FIGURE in the drawing shows a diagrammatic section through a percussion drill hammer operated with a hydraulic fluid, omitting details which are of lesser importance in the present context.

DETAILED DESCRIPTION OF THE PREFERRED EMBODIMENTS

The percussion drill hammer 10 shown possesses a casing 11 which is provided at one end with two handles 12, 13 and at the other end with a tool mounting 14 which is only diagrammatically indicated and into which, for example, a longitudinally displaceable drilling bit 15 can be inserted. The head 16 of the drilling bit 15 is periodically—as will be seen below—subjected to impacts by the front end 17 of an elongate hammer piston 18.

In the casing 11, an inlet 19—shown only diagrammatically—is formed which is connected via a line to a suitable pressure source (both of these are not shown-)—in this case to a pressure source for a hydraulic fluid. The inlet 19 leads into the widened part 20 of a slider chamber 21 in which a valve slider 23 or spool valve, provided with two valve pistons 22, 22', is mounted to be displaceable against the action of a spring 24. The end 25 of the valve slider 23, remote from the spring 24, projects from the casing 11 and bears against an actuating lever 27 hinged to the handle 13 at pivot pin 26. At the end remote from the widened part 20, an outlet 28 starts from the slider chamber 21 and this is connected in this case via a return line, which is not shown, to a sump or a stock vessel or reservoir, from which the pressure source takes the fluid.

From the widened part 20 of the slider chamber 21, a passage 29 leads to a branch position 30 which is the starting point for a channel 32 leading to a pressure accumulator 31, and also a passage 33 leads to the central zone of a further slider chamber 34, and finally, a further channel 35 which will be referred to later starts at its top from the rear of the widened part 20.

The pressure accumulator 31 has a chamber 36 which is divided by a dense, elastically extensible diaphragm into two compartments 38, 39, the channel 32 opening into the compartment 39. By contrast, the compartment 38 contains a gas which is under a pressure which is comparable to the fluid pressure at the inlet 19.

The slider chamber 34 has a widened zone or region 40 and contains a control slider or spool valve 41 with two valve pistons 42, 43, of which the valve piston 43 is provided with a circumferential collar 45. One end of the slider chamber 34 is connected via a passage 44 to the channel 32 leading to the compartment 39. At the other end of the slider chamber 34, a channel 46 starts, which will be referred to later. Finally, the widened zone 40 of the slider chamber 34 is the starting point for a passage 47 communicating via the slider chamber 21 with the outlet 28 and, at the same height as the passage 47, a channel 48 which serves as a collecting channel for three return channels or leakage channels 49, 50 and 51, starts from the widened zone 40.

In the casing 11, a cylinder 52 is formed in which the hammer piston 18 is mounted for reciprocating motion. At its end remote from the end 17, the hammer piston 18 has a collar 53 which is seated in the cylinder 52 in a sliding fit, but makes a seal. The collar 53 is followed by a section 54 of smaller diameter, so that a shell-like interspace 55 remains free towards the inner wall of the cylinder 52. The section 54 is followed by a further collar 56 which, as will be seen later, acts as a valve piston together with the channel 46, or the end thereof leading into the cylinder 52, and has two control edges 57, 58 for this purpose. The collar 56 is first followed by a cylindrical section 59 of approximately the same diameter as that of the section 54, and the section 59 is followed by a piston shank 60 which extends in sliding fit through a passage bore 61 coaxial to the cylinder 52 and forms the end 17 of the hammer piston 18. At its end nearer to the cylinder 52, the passage bore 61 is provided with a small recess or shoulder 62 which, together with the section 59, acts as a brake for the case where the head 16 of the bit 15 yields too rapidly to the impact of the hammer piston 18.

That part 65 of the cylinder 52 which is adjacent to the free end face 63 of the collar 53 forms a pressure chamber and is connected via a passage 64 to the slider chamber 34. The return channel 49 leads into the cylinder 52 between the collars 53 and 56, and the channel 35 leads into the cylinder 52 in the immediate vicinity of the small recess or shoulder 62.

The part 65 of the cylinder 52 is the starting point for a passage 66 which continues through a central bore 67 in a guide pin 68 which extends into a chamber 69, formed coaxially to the cylinder 52 in the casing 11, and is rigidly joined to the casing 11 at both ends in this chamber 69. On the guide pin 68, which is stepped down to a smaller diameter at approximately half its height, a balance or compensation mass body 70 provided in the chamber 69 is mounted to be longitudinally displaceable against the action of a spring 71. The mass body 70 is essentially bell-shaped and has a bore 72, forming a chamber by means of which the mass body 70 is seated in a sliding fit on the thicker section of the guide pin 68.

Between the bore 72 and the thinner section 68' of the guide pin 68, a space 73 remains free which communicates via the bore 67 and passage 66 with the part 65 of the cylinder 52. The bore 72 forming the chamber ends in an annular surface 74, the surface area of which approximately corresponds to the surface area of the end face 63 minus the surface areas of the annular surfaces of the control edge 58 and that at the end of the section 59, as is indicated in dashed lines and by the double bracket above the end face 63. Thus, the end face 63 will be seen to form a first effective surface and the sections 56 and 59 form a second effective surface at the hammer piston 18 which is smaller than this first effective surface.

Together with the spring 71 which is supported at one end on the end of the chamber 69 and hence on the casing 11 and, at the other end, on a shoulder 75 on the mass body 70, the balance mass body 70 forms an oscillator, the characteristic cyclic oscillation frequency of which is approximately $$f_{res} \cong \sqrt{c/m}$$

wherein c denotes the spring constant of the spring 71 and m denotes the mass of the body 70; both these are thus mere sizing parameters. As will be seen later, these sizing parameters should be selected such that the characteristic cyclic oscillation frequency corresponds at most to half, but preferably to one-third, of the frequency of the pressure pulses which act on the end face 63, and thus, cause the hammer piston 18 each time to execute a percussive stroke.

OPERATION OF THE INVENTION

In the present case, these periodic pressure pulses are generated as follows. In FIG. 1 the percussion drill hammer 10 is shown in the switched-off state. Pressure fluid fed to the inlet 19 flows via the slider chamber 21 directly to the outlet 28. However, as soon as the actuating lever 27 is pressed, the valve slider 23 is forced into the slider chamber 21 against the action of the spring 24 and the valve piston 22 interrupts the flow connection between widened part 20 and slider chamber 21. Thus, pressure is built up in the passage 29, in the channels 32, 35, in the passage 33, and hence also in the slider chamber 34, in the passage 64 and in the part 65 of the cylinder 52. The pressure in the part 65 drives the hammer piston 18 downwardly, since the area of the end face 63 is greater than the sum of the annular areas of the control edge 58 on the bottom side of collar 56 and the control edge (unnumbered) on the bottom side of cylindrical section 59. At the same time, however, the pressure also acts via the annular surface 74 on the balance or compensation mass body 70 and lifts the latter off its rest position. As soon as the collar 56, that is to say its control edge 57, has freed the channel 46, the latter communicates via the space 55 with the unpressurized channel 49, that is to say, the pressure on the end face of the collar 45 is released. However, the pressure now also acts via the passage 44 on the free side of the valve piston 42, so that the control slider 41 is displaced downwards. This has the consequence that, on the one hand, the passage 33 is closed and, on the other hand, the passage 64 is connected to the passage 47. The part 65 is thus connected to the outlet 28, while the pressure fluid, still flowing in, collects in the pressure accumulator 31. Since the channel 35 is not affected by the movement of the control slider 41, the hammer piston 18 is now forced back upwardly by the action of the pressure fluid on the annular surfaces of 58, 59, and specifically until the control edge 58 has restored the connection of the channel 46 to the pressurized channel 35. Since the part 65 of the cylinder 52 is unpressurized in this phase, the action on the balance mass body 70 also dissipates, and the latter thus again approaches its starting position, to the extent that the force of the spring 71 is capable of displacing fluid through the bore 67 and the passage 66.

However, as soon as the channels 35 and 46 are interconnected, the control slider 41 is, due to the larger surface area of the collar 45, subjected to a force which moves the control slider 41 back into the starting position shown in the FIGURE, so that a new pressure pulse is generated in the part 65.

Since, due to its low mass, the control slider 41 has considerably less inertia than the balance or compensation mass body 70, it returns to its starting position before the body 70 has again reached its starting position.

The pulses acting cyclically on the body 70 at the frequency of the pressure pulses thus entail, on the one hand, a "static" deflection of the body 70 against the spring force, and an oscillation which is sinusoidal as a rough approximation is superposed on this deflection.

The "static" deflection depends on the force, exerted by the pressure pulses, multiplied with the duration of the pressure pulses or—expressed in other words—on the percussive power of the drill hammer. The oscillation superposed on the "static" deflection of the body 70 depends on the force, exerted by the pressure pulses, and on the mass of the body 70, but it is virtually independent of the spring constant of the spring 71. As already mentioned, these two values of the spring constant and mass are selected such that the characteristic cyclic oscillation frequency of the body 70 corresponds at most to one half preferably one third of the frequency of the pressure pulses. The body 70 thus forms a second order oscillator, and the oscillating motion of the latter takes place with a phase shaft of about 180°, relative to the percussive strokes of the hammer piston 18.

As a result, the casing 11 does not suffer a shock-like recoil at each pressure pulse acting on the hammer piston 18, but it is merely subject to the force which is exerted by the spring 71 and oscillates approximately sinusoidally about a constant value. By a corresponding choice of the system parameters, it is thus possible, at any time, to keep this force lower than the weight of the casing 11, so that the latter never undergoes an acceleration in the direction of the operator.

It is self-evident that the principle of smoothing the pressure pulses acting on the casing 11 can also be realized for pneumatically operated percussion drill hammers. In this case, the return line starting from the outlet 28 would be omitted and, at most, would be replaced by a silencer.

To control the frequency of the pressure pulses and hence of the percussive strokes, it is also possible to insert in the channel 35 a non-return valve which closes towards the cylinder 52 and has a large flow cross-section, and to insert a restrictor parallel to this non-return valve. In this way, the percussive stroke of the hammer piston 18 can proceed virtually unhindered, while the return stroke takes place only as a function of the pressure fluid flowing through the restrictor.

The foregoing preferred embodiment is considered illustrative only. Numerous other modifications and changes will readily occur to those skilled in the art and, consequently, the disclosed invention is not limited to the exact construction and operation shown and described hereinabove.

What I claim is:

1. A percussion drill hammer comprising:

a casing;

handle means secured to said casing;

a cylinder within said casing;

said cylinder comprising a pressure chamber;

a hammer piston mounted for reciprocating movement within said cylinder;

said hammer piston having a first effective surface facing the pressure chamber and a second effective surface facing away from the pressure chamber;

means for feeding periodic pressure pulses of a pressure fluid at a predetermined pulse frequency to said pressure chamber;

said periodic pressure pulses impinging on said first effective surface of said hammer piston for causing the latter to perform percussion strokes;

means for constantly feeding a pressure fluid at a constant pressure acting on said second effective surface of said hammer piston for causing the latter to return against the percussion strokes;

spring means having a spring constant;

said casing having mounted therein a balance mass body having a mass and a further chamber located within said balance mass body and between positioned between said balance mass body and the hammer piston;

said further chamber having an end face facing said pressure chamber;

said balance mass body being displaceable within said casing in a direction parallel but opposite to the movement of said hammer piston with respect to the position of the pressure chamber and against the action of the spring means supported in said casing;

said periodic pressure pulses impinging on the end face of said further chamber in said balance mass body in a direction opposite to that for the hammer piston;

said balance mass body and said spring means together defining an oscillatory system having a characteristic cyclic oscillation frequency;

said characteristic cyclic oscillation frequency being defined by the mass of the balance mass body and by the spring constant of the spring means;

said characteristic cyclic oscillation frequency being in the range from one half to one third of said predetermined pulse frequency;

said second effective surface being smaller than said first effective surface at said hammer piston;

the area of said end face of said further chamber substantially corresponding to the difference between said first and said second effective surfaces at said hammer piston; and whereby the casing does not suffer a shock-like recoil when each periodic pressure pulse impinges in one direction on the hammer piston.

2. The percussion drill hammer according to claim 1, wherein:

the balance mass body and the spring means are arranged in a cylindrical chamber which is formed coaxially with the cylinder in the casing.

3. The percussion drill hammer as defined in claim 2, wherein:

said balance mass body forms a cylindrical body arranged in said cylindrical chamber with radial play; and a guide pin on which there is displaceably mounted said balance mass body.

4. The percussion drill hammer according to claim 1, wherein:

said balance mass body defines a space which is in flow connection with said pressure chamber;

said balance mass body is formed as a cylindrical body arranged on the same axis as the hammer piston and has a cylindrical bore means for defining said space and for displaceably mounting the cylindrical body of the balance mass body on a guide pin; and said space communicates via a passage formed in the guide pin with said pressure chamber.

* * * * *